US008188925B2

(12) United States Patent
DeJean

(10) Patent No.: US 8,188,925 B2
(45) Date of Patent: May 29, 2012

(54) BENT MONOPOLE ANTENNA WITH SHARED SEGMENTS

(75) Inventor: Gerald R. DeJean, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 413 days.

(21) Appl. No.: 12/267,480

(22) Filed: Nov. 7, 2008

(65) Prior Publication Data

US 2010/0117909 A1 May 13, 2010

(51) Int. Cl.
*H01Q 5/00* (2006.01)

(52) U.S. Cl. ..... 343/700 MS; 343/702; 343/893

(58) Field of Classification Search ..... 343/702, 343/700 MS, 793, 893
See application file for complete search history.

(56) References Cited

U.S. PATENT DOCUMENTS

| | | | | |
|---|---|---|---|---|
| 6,239,765 | B1 * | 5/2001 | Johnson et al. | 343/795 |
| 6,683,570 | B2 | 1/2004 | Skladany et al. | |
| 6,734,825 | B1 * | 5/2004 | Guo et al. | 343/700 MS |
| 6,956,530 | B2 | 10/2005 | Kadambi et al. | |
| 7,053,844 | B2 | 5/2006 | Gaucher et al. | |
| 7,286,094 | B2 | 10/2007 | Ratni et al. | |
| 7,522,104 | B2 * | 4/2009 | Sugiyama | 343/700 MS |
| 2008/0150830 | A1 | 6/2008 | Pan et al. | |
| 2008/0158067 | A1 | 7/2008 | Mei | |

OTHER PUBLICATIONS

John, et al., "Printed Triband Terminal Antenna", Wideband and Multi-band Antennas and Arrays, 2005. IEE (Ref. No. 2005/11059), Publication Date: Sep. 7, 2005, pp. 19-24.

Chou, et al., "Switchable Printed Monopole Antenna with Frequency Diversity for Wifi/2.6 Ghz Wimax/3.5 Ghz Wimax Applications", TENCON 2007—2007 IEEE Region 10 Conference, Dated: Oct. 30, 2007-Nov. 2, 200, pp. 1-3.

Lee, et al., "A Compact Printed Hook-Shaped Monopole Antenna for 2.4/5-Ghzwlan Applications", Microwave and Optical Technology Letters/ vol. 48, No. 2, Dated: Feb. 2006, pp. 327-329.

Chen, et al., "Novel Design of Printed Monopole Antenna for WLAN/WiMAX Applications", 2007 IEEE Antennas and Propagation Society International Symposium, Dated: Jun. 9-15, 2007 pp. 3281-3284.

Onat, et al., "Design and Implementation of a Triple-Band Re-Configurable Microstrip Antenna", The 9th European Conference on Wireless Technology, 2006, Dated: Sep. 10-12, 2006, pp. 326-329.

Liang, et al., "Printed S-Shaped Monopole Antenna for Tri-Band WLAN Application", 7th International Symposium on Antennas, Propagation & EM Theory, 2006. ISAPE apos;06, Dated: Oct. 2006 pp. 1-3.

(Continued)

*Primary Examiner* — Trinh Dinh
(74) *Attorney, Agent, or Firm* — Joseph R. Kelly; Westman, Champlin & Kelly, P.A.

(57) ABSTRACT

A bent monopole antenna with shared segments is capable of tri-band communication. In an example embodiment, an antenna assembly includes a substrate, a first bent monopole, a second bent monopole, and a third bent monopole. The first, second, and third bent monopoles are disposed on the substrate. The first bent monopole includes a feedline segment and a first segment. The second bent monopole includes the feedline segment and the first segment. The third bent monopole includes the feedline segment and a second segment. The first, second, and third bent monopoles share the feedline segment, while the first and second bent monopoles also share the first segment. A T-junction is formed by the feedline segment, the first segment, and the second segment. In an example implementation, the first segment has a first width, and the second segment has a second width, with the first width being greater than the second width.

16 Claims, 8 Drawing Sheets

OTHER PUBLICATIONS

Shen, et al., "A Printed Triple-Band Antenna for WiFi and WiMAX Applications", Proceedings of Asia-Pacific Microwave Conference, 2006. APMC 2006, Dated: Dec. 12-15, 2006 pp. 1715-1717.
Cherry, Steven M., "WiMAX and Wi-Fi: Separate and Unequal", IEEE Spectrum, vol. 41, Issue 3, Dated: Mar. 2004 pp. 16-16.
Vaughen-Nichols, Steven J., "Achieving Wireless Broadband with WiMAX", Computer, Publication Date: Jun. 2004, vol. 37, Issue: 6, pp. 10-13.
Fourty, et al., "Comparative Analysis of New High Data Rate Wireless Communication Technologies "From Wi-Fi to WiMAX"", Proceedings of the Joint International Conference on Autonomic and Autonomous Systems and International Conference on Networking and Services (ICAS/ICNS 2005), Year of Publication: 2005, pp. 66-71.
Baines, Rupert, "The Roadmap to Mobile WiMAX", Communications Engineer, vol. 3, Issue 4, Dated: Aug.-Sep. 2005, pp. 30-34.
Sargeant, et al., "The Promise of WiMAX", © Motorola, Inc. 2005, pp. 1-8.
Behmann, Fawzi, "Impact of Wireless (Wi-Fi, WiMAX) on 3G and Next Generation—An Initial Assessment", 2005 IEEE International Conference on Electro Information Technology, Dated: May 22-25, 2005, pp. 1-6.
Kim, et al., "A Dual Band Printed Dipole Antenna with Spiral Structure for WLAN Application", IEEE Microwave and Wireless Components Letters, vol. 15, No. 12, Dated: Dec. 2005, pp. 910-912.
Moon, et al., "Small Chip Antenna for 2.4/5.8-GHz Dual ISM-Band Applications", IEEE Antennas and Wireless Propagation Letters, vol. 2, Dated: 2003, pp. 313-315.
Wu, et al., "Dual-Broadband T-Shaped Monopole Antenna for Wireless Communication", 2005 IEEE Antennas and Propagation Society International Symposium, vol. 1A, Dated: Jul. 3-8, 2005 pp. 470-473.
Mahler, et al., "Design and Optimisation of an Antenna Array for WiMAX Base Stations", IEEE/ACES International Conference on Wireless Communications and Applied Computational Electromagnetics, 2005, Dated: Apr. 3-7, 2005, pp. 1006-1009.
Pan, et al., "Dual Wideband Printed Monopole Antenna for WLAN/WiMAX Applications", IEEE Antennas and Wireless Propagation Letters, vol. 6, Dated: 2007 pp. 149-151.

* cited by examiner

204

BENT MONOPOLE ANTENNA WITH SHARED SEGMENTS

BACKGROUND

The availability of relatively inexpensive, low-error, and high-bandwidth communication plays a prominent role in creating and maintaining today's information-oriented economy. Wireless communications in particular provide an omnipresent capability to exchange ideas and information. In a wireless communication exchange, electromagnetic radiation is transmitted from one device and received at another. Each device usually transmits and receives electromagnetic signals during a given communication exchange.

The electromagnetic signals are typically propagated between two devices over the air. The electromagnetic signals are transferred to and from the air medium using an antenna. Hence, the antenna acts as a bridge between the device and the transmission medium. Although electromagnetic signals travel at one basic speed, they have different wavelengths and frequencies. Different antennas are adept at interacting with electromagnetic signals of different frequency ranges or bandwidths.

Wireless communication is controlled by different wireless standards and/or governmental regulations. These standards and regulations assign particular types of communications to different frequency bandwidths. Being able to communicate in different frequency bandwidths can increase wireless options in certain communication scenarios. Consequently, many devices today can operate in more than one frequency band.

To properly communicate in multiple frequency bands, such devices often include an antenna for each desired frequency band. Alternatively, designers often try to cover two or more bands with a single antenna. This often leads to a number of compromises, including those related to antenna size, transceiver complexity, and overall communication performance.

One multi-band antenna design was presented by M. John, M. J. Ammann, and R. Farrell in a paper entitled "Printed Triband Terminal Antenna"; IEE Conf., Wideband and Multiband Antennas and Arrays; Birmingham, 2005; pages 19-23. These authors refer to their antenna as a "printed triple-band multibranch monopole." A version of their triband antenna is depicted in FIG. 1.

FIG. 1 depicts a triband antenna assembly 101 in accordance with an existing design presented by John, Ammann, and Farrell. As illustrated, triband antenna assembly 101 includes a microstrip feedline 103, a groundplane 105, and a multibranch monopole 107. Microstrip feedline 103 and multibranch monopole 107 are located on the front of a substrate of triband antenna assembly 101. Groundplane 105 may be square and is located on the back of the substrate.

Multibranch monopole 107 includes three monopole branches 107*a*, 107*b*, and 107*c*. Microstrip feedline 103, monopole branch 107*a*, monopole branch 107*b*, and monopole branch 107*c* form a "plus-shaped" junction. Monopole branch 107*b* extends from the plus-shaped junction parallel to microstrip feedline 103 in an apparent extension thereof. Monopole branch 107*b* is straight. Monopole branch 107*a* and monopole branch 107*c* extend from the plus-shaped junction perpendicular to microstrip feedline 103. Each of monopole branch 107*a* and monopole branch 107*c* includes one bend.

According to the authors, this triband antenna assembly 101 is designed to operate in three bands. However, this antenna is larger than is suitable for all applications and frequency bands that may be desirable (e.g., it may be too large for some portable devices and purposes). Moreover, drawbacks relating to having a plus-shaped junction, which are explained further herein below, have been discovered by the inventor of the instant patent application.

SUMMARY

A bent monopole antenna with shared segments is capable of tri-band communication. In an example embodiment, a device has an antenna assembly that includes a substrate, a first bent monopole, a second bent monopole, and a third bent monopole. The first bent monopole is disposed on the substrate, with the first bent monopole including a feedline segment and a first segment. The second bent monopole is disposed on the substrate, with the second bent monopole including the feedline segment and the first segment. The third bent monopole is disposed on the substrate, with the third bent monopole including the feedline segment and a second segment.

A T-junction is formed by the feedline segment, the first segment, and the second segment. The feedline segment is shared by the first bent monopole, the second bent monopole, and the third bent monopole. The first segment is shared by the first bent monopole and the second bent monopole. A first combination of a first length and one or more bends of the first bent monopole tune the first bent monopole to substantially match a first bandwidth. A second combination of a second length and one or more bends of the second bent monopole tune the second bent monopole to substantially match a second bandwidth. A third combination of a third length and one or more bends of the third bent monopole tune the third bent monopole to substantially match a third bandwidth.

In an example implementation, the first segment has a first width, and the second segment has a second width. The first width of the first segment is established to be greater than the second width of the second segment. For instance, the first width of the first segment may be 20% to 40% greater than the second width of the second segment. Also, in another example implementation, the first bandwidth may correspond to a Worldwide Interoperability for Microwave Access (WiMAX) frequency band of 2.3-2.7 GHz, the second bandwidth may correspond to a WiMAX frequency band of 3.3-3.7 GHz, and the third bandwidth may correspond to a WiMAX frequency band of 5.8 GHz.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Moreover, other systems, methods, devices, assemblies, apparatuses, arrangements, and other example embodiments are described herein.

BRIEF DESCRIPTION OF THE DRAWINGS

The same numbers are used throughout the drawings to reference like and/or corresponding aspects, features, and components.

DETAILED DESCRIPTION

Figure 1:
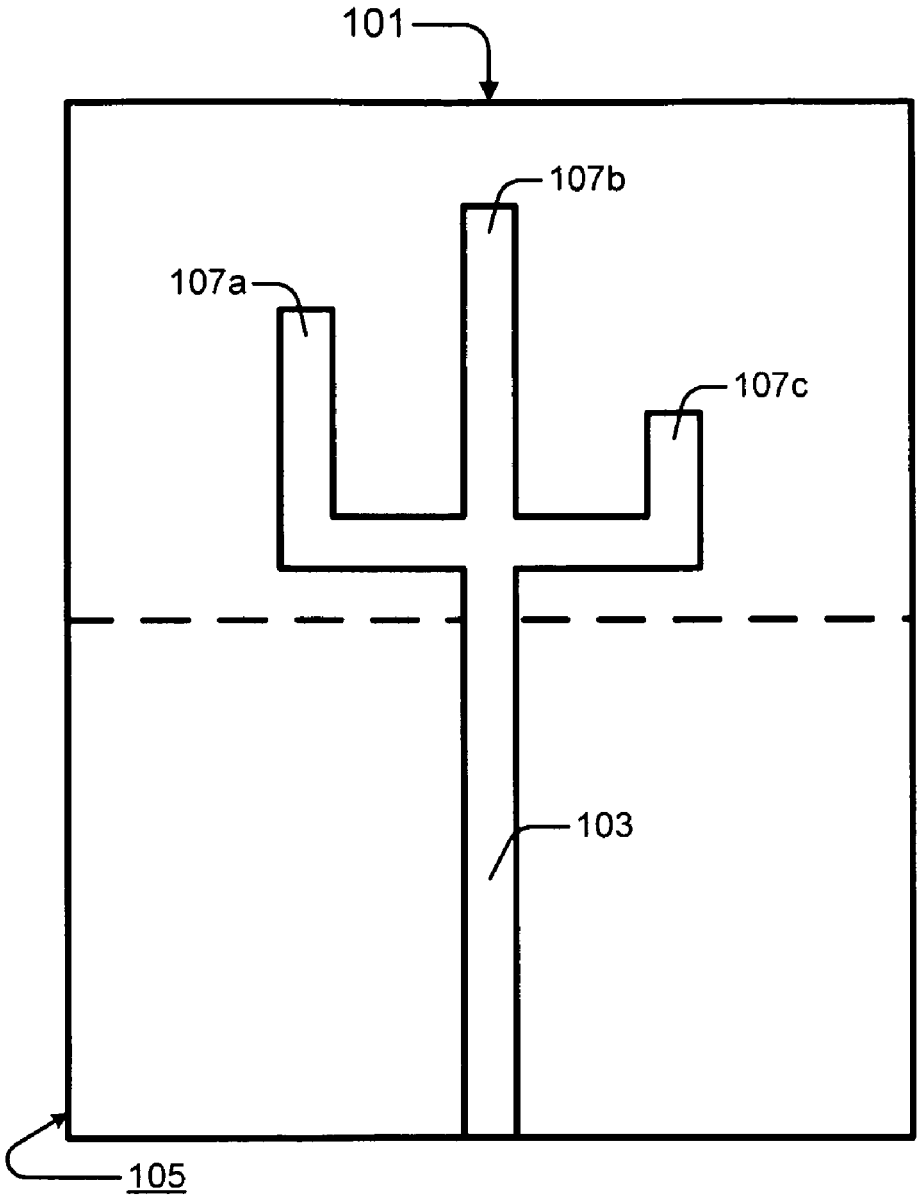
Prior Art FIG. 1
FIG. 1 depicts a triband antenna assembly in accordance with an existing design.

As described herein above with particular reference to FIG. 1, an antenna having a plus-shaped junction has been previously presented. However, with a plus shaped junction, a significant portion of the signal energy that is applied via the feedline automatically flows straight into the monopole that is parallel to the feedline. Consequently, other monopoles are effectively shortchanged.

In contrast, for an example embodiment that is described further herein, three bent monopoles extend from a T-junction that is formed from a feedline segment, a first segment, and a second segment. First, second, and third bent monopoles share the feedline segment. First and second bent monopoles share the first segment. The second segment is part of the third bent monopole and is unshared.

In an example implementation, the first segment has a first width, and the second segment has a second width. The first width of the first segment is greater than the second width of the second segment. With the first width of the first segment being greater than the second width of the second segment, relatively more signal energy from the feedline segment may be channeled to the first bent monopole and the second bent monopole jointly as compared to the third bent monopole.

Over the past few years, WiMAX technology has gained interest in metropolitan area network (MAN) and wireless MAN (WMAN) applications. This is partly due to its potential to interface IEEE 802.11 Wireless Fidelity (Wi-Fi) hotspots with other areas of the internet and to provide a wireless alternative to last mile communications. In fact, carriers can use WiMAX to provide point-to-multipoint wireless networking generally.

Recently, bands between 2-11 GHz were added to WiMAX to provide increased bandwidth and connectivity to ports that are not in the line-of-sight. This added bandwidth opened the door further for WiMAX technology to be used for broadband wireless access, which typically operates at non-cellular frequencies above 2 GHz. This generally includes the 2.5 GHz band (2.3-2.7 GHz) used in North America for Wi-Fi applications, the 3.5 GHz band (3.3-3.7 GHz) used in Europe and the Asian Pacific regions, and the band around 5.8 GHz.

In one relatively-specific implementation, a tri-band antenna design can be used at three frequency bands for WiMAX applications: the 2.3-2.7 GHz band, the 3.3-3.7 GHz band, and the 5.8 GHz band. A configuration for the antenna is based on multiple printed monopoles that include bends. The bends in the antenna structure allow for the resonant frequency to be reduced when the length is increased (e.g., based on the increased inductance) while at the same time the bends also enable a compact antenna layout. Such an antenna implementation can provide relatively constant, omni-directional radiation for each of the three bands. Gains between 2-4 dBi, for example, can be achieved with this antenna when it is printed on a substrate that is thin and low-loss and that has a low dielectric constant.

Figure 2:
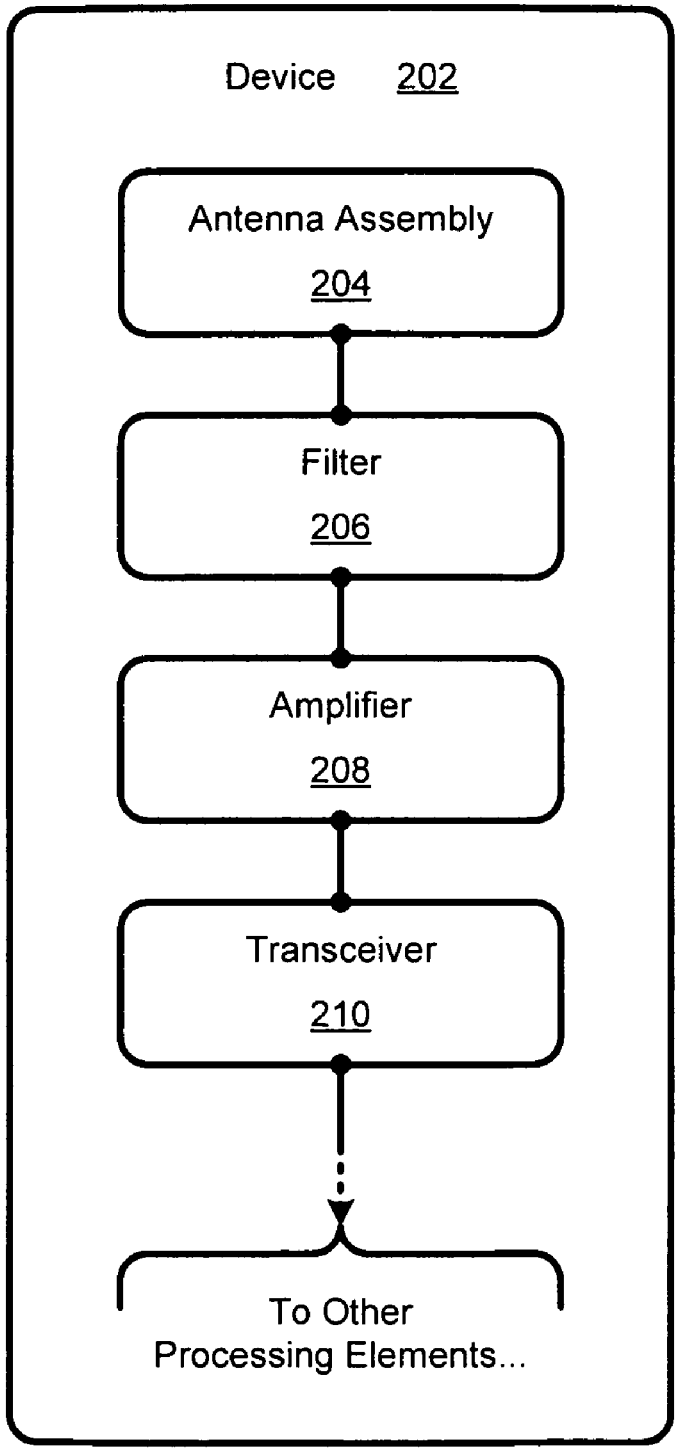
FIG. 2 is a block diagram of an example device that may include an antenna assembly that is capable of tri-band communication.

FIG. 2 is a block diagram of an example device 202 that may include an antenna assembly 204 that is capable of tri-band communication. As illustrated, device 202 includes a filter 206, an amplifier 208, and a transceiver 210, in addition to antenna assembly 204. For example embodiments, filter 206 filters an incoming signal prior to forwarding it to amplifier 208. Amplifier 208 amplifies the signal for transceiver 210. Transceiver 210 is a transmitter and/or receiver that demodulates the signal that is being propagated via an antenna of antenna assembly 204. The receiving chain is coupled to other processing elements as indicated in FIG. 2. It should be understood that a receiving chain for antenna assembly 204 may include components that differ from those of FIG. 2.

Although four elements of device 202 are shown in FIG. 2, device 202 may actually include more or fewer (and/or different) elements. Device 202 may comprise any electronic apparatus or other machine that is capable of communicating using antenna assembly 204. Examples for device 202 include, but are not limited to, a wireless network interface card, a wireless modem, a radio, a wireless access point, a network component, a server computer, a personal computer, a hand-held or other portable electronic gadget, a mobile phone, an entertainment appliance, some combination thereof, and so forth.

Figure 3:
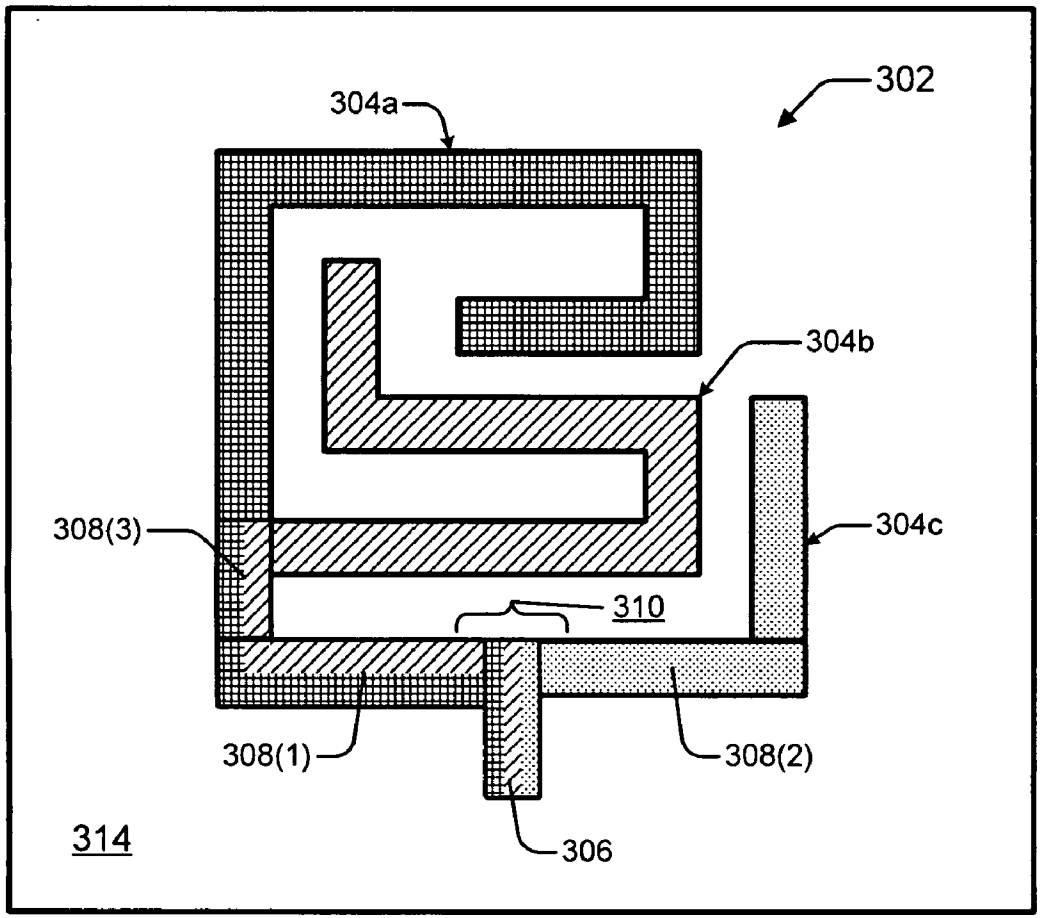
FIG. 3 illustrates an example antenna that includes three bent monopoles, a T-junction, and shared segments.
Figure 3:
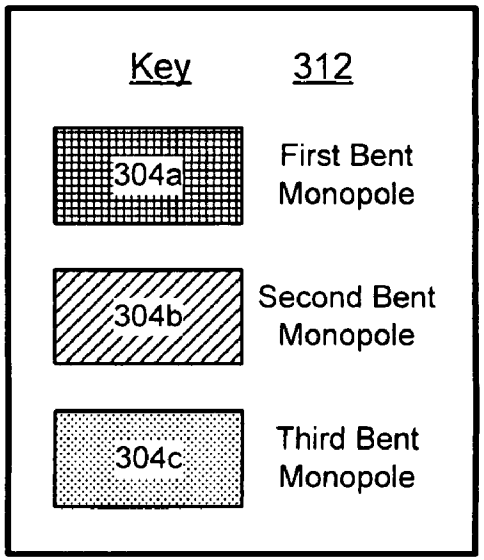

FIG. 3 illustrates an example antenna 302 that includes three bent monopoles 304, a T-junction 310, and shared segments 306 and 308. As illustrated, antenna 302 is disposed on a substrate 314 and includes three bent monopoles 304: a first bent monopole 304*a*, a second bent monopole 304*b*, and a third bent monopole 304*c*. Four segments are explicitly indicated: a feedline segment 306, a first segment 308(1), a second segment 308(2), and a third segment 308(3). It should be noted that the drawings of FIGS. 3-6 are not necessarily drawn to scale.

A key 312 is also shown. Key 312 is directed to enabling the visual differentiation between and among first bent monopole 304*a*, second bent monopole 304*b*, and third bent monopole 304*c* using shading patterns. More specifically, key 312 indicates which segments 306 and 308 and other parts of antenna 302 correspond to which bent monopole 304. First bent monopole 304*a* is represented by a cross-hatched shading pattern. Second bent monopole 304*b* is represented by a shading pattern having diagonal lines. Third bent monopole 304*c* is represented by shading with a dotted pattern.

For example embodiments, antenna 302 is disposed on substrate 314 and is fed a signal via feedline segment 306. Feedline segment 306, first segment 308(1), and second segment 308(2) form T-junction 310 on substrate 314. As indicated by the shading patterns and key 312, feedline segment 306 is shared by first bent monopole 304*a*, second bent monopole 304*b*, and third bent monopole 304*c*. First segment 308(1) and third segment 308(3) are shared by first bent monopole 304*a* and second bent monopole 304*b*. Second segment 308(2) is part of third bent monopole 304*c*, but second segment 308(2) is not shared.

Each of bent monopoles 304*a*, 304*b*, and 304*c* include at least one bend. For instance, each bent monopole 304 includes at least a bend at T-junction 310. First bent monopole 304*a* has five bends, including the one at T-junction 310. Second bent monopole 304*b* includes six bends. Third bent monopole 304*c* includes two bends. Bends and additional segments are described further herein below with particular reference to FIGS. 5A-5D.

Thus, in an example embodiment, an antenna assembly 204 (e.g., of FIG. 2) is capable of tri-band communication and includes a substrate 314 and first, second, and third bent monopoles 304. First bent monopole 304*a* is disposed on substrate 314, with first bent monopole 304*a* include a feedline segment 306 and a first segment 308(1). Second bent monopole 304*b* is disposed on substrate 314, with second bent monopole 304*b* also including feedline segment 306 and first segment 308(1). Third bent monopole 304*c* is disposed on substrate 314, with third bent monopole 304*c* including feedline segment 306 and a second segment 308(2). A T-junction 310 is formed by feedline segment 306, first segment 308(1), and second segment 308(2). Feedline segment 306 is shared by first bent monopole 304*a*, second bent monopole 304*b*, and third bent monopole 304*c*. First segment 308(1) is shared by first bent monopole 304*a* and second bent monopole 304*b*.

Figure 4:
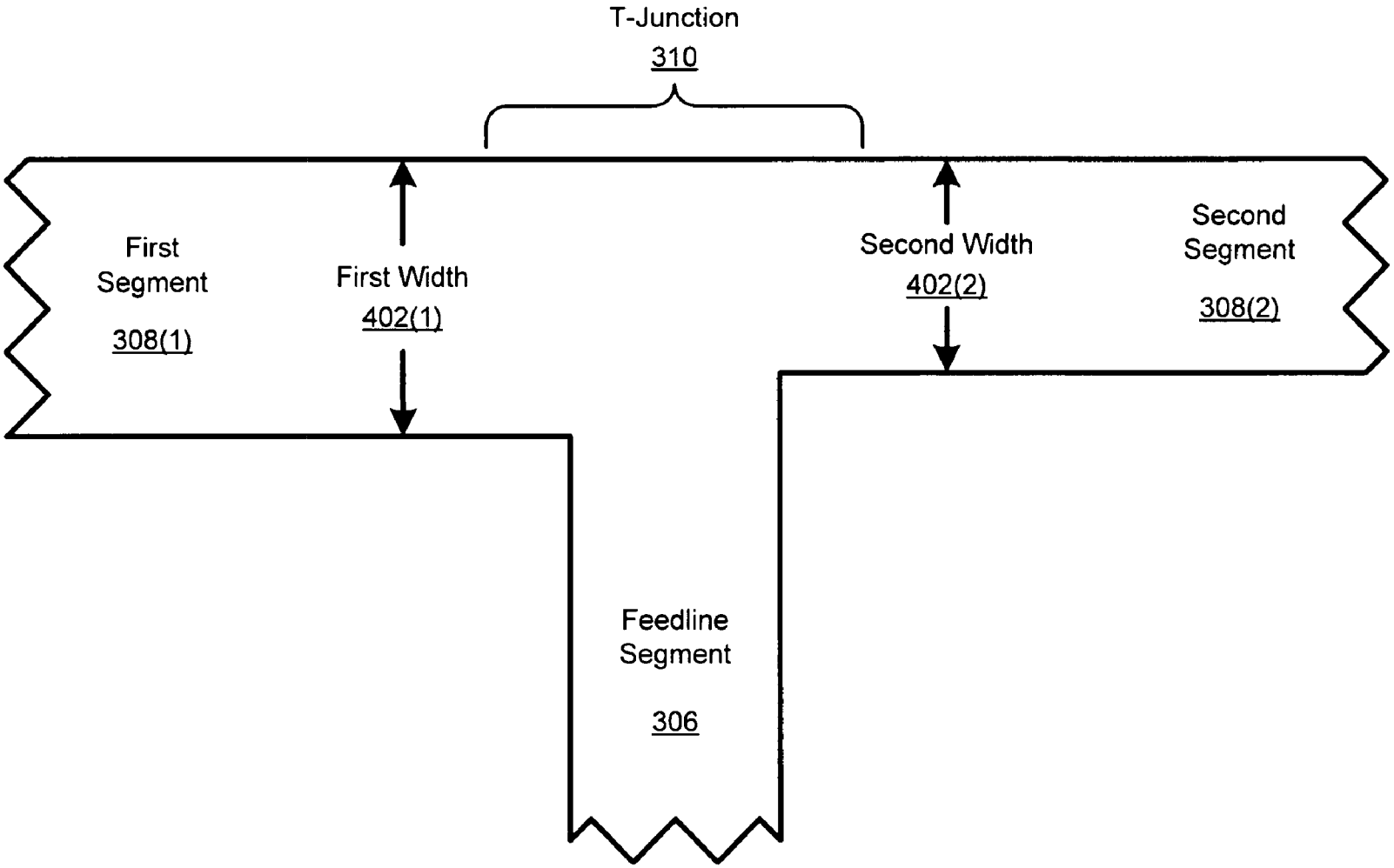
FIG. 4 illustrates an example T-junction of the antenna of FIG. 3.

FIG. 4 illustrates an example T-junction 310 of antenna 302 (of FIG. 3). As described above, T-junction 310 is formed, at least partially, from feedline segment 306, first segment 308 (1), and second segment 308(2). As illustrated, first segment 308(1) has and is associated with a first width 402(1), and second segment 308(2) has and is associated with a second width 402(2). It should be understood that the region indicated by the bracket for T-junction 310 is approximate.

For example embodiments, first width 402(1) of first segment 308(1) is wider than second width 402(2) of second segment 308(2). With reference to FIG. 3, first segment 308 (1) is shared by first bent monopole 304*a* and second bent monopole 304*b*. Each of these two bent monopoles 304 includes multiple bends. In fact, each includes more than two bends (i.e., five and six bends, respectively). Generally, some non-zero level of signal energy is consumed at each bend.

In an example implementation, a first segment 308(1) has a first width 402(1), and a second segment 308(2) has a second width 402(2). First width 402(1) of first segment 308(1) is greater than second width 402(2) of second segment 308(2). In another example implementation, first width 402(1) of first segment 308(1) being greater than second width 402(2) of second segment 308(2) is to enable relatively more signal energy from feedline segment 306 to be channeled to first bent monopole 304*a* (of FIG. 3) and second bent monopole 304*b* jointly as compared to that being channeled to third bent monopole 304*c*.

A specific numeric example having lengths and widths for the bent monopoles and segments of the antenna is provided herein below with particular reference to FIGS. 5A-5D and 6. However, and by way of example only, first width 402(1) of first segment 308(1) may be 20% to 40% greater than second width 402(2) of second segment 308(2). As noted above generally, FIG. 4 is not necessarily drawn to scale.

Figure 5A:
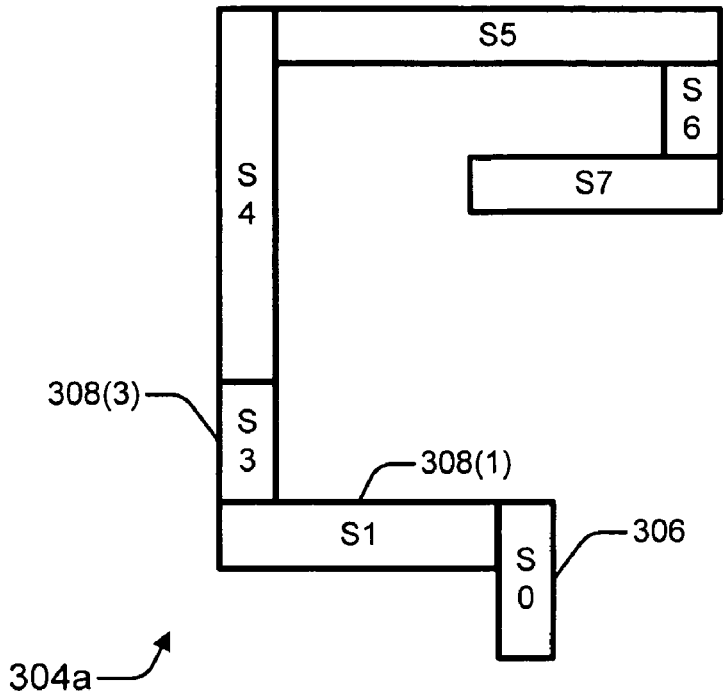
FIGS. 5A, 5B, and 5C individually illustrate first, second, and third bent monopoles, respectively, in terms of their constituent segments.
Figure 5B:
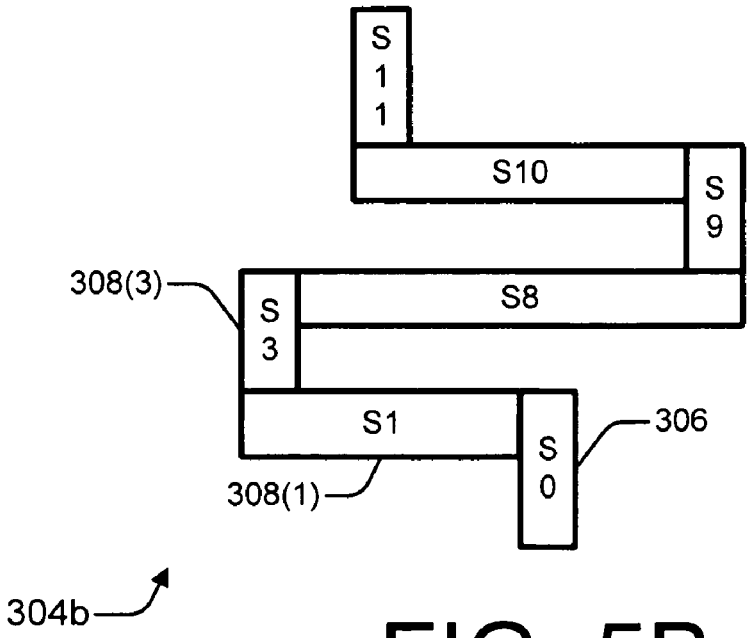
Figure 5C:
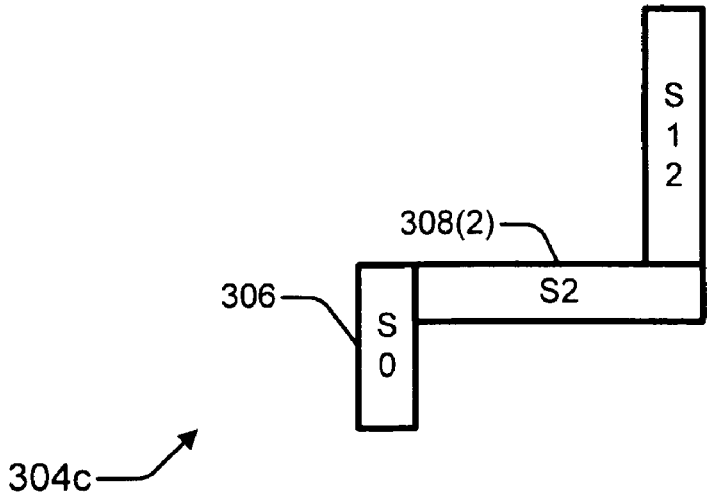

FIGS. 5A, 5B, and 5C individually illustrate first, second, and third bent monopoles 304, respectively, in terms of their constituent segments 306 and 308. More specifically, first bent monopole 304*a* is shown in FIG. 5A, second bent monopole 304*b* is shown in FIG. 5B, and third bent monopole 304*c* is shown in FIG. 5C. Shared segments, such as feedline segment 306 and first segment 308(1), are shown in multiple ones of these FIGS. 5A-5C.

With reference to FIG. 5A, an example for first bent monopole 304*a* includes feedline segment 306, first segment 308 (1), and third segment 308(3). These correspond to segments S0, S1, and S3. First bent monopole 304*a* also includes segments S4, S5, S6, and S7. The five bends of first bent monopole 304*a* are also shown.

With reference to FIG. 5B, an example for second bent monopole 304*b* includes feedline segment 306, first segment 308(1), and third segment 308(3). These correspond to segments S0, S1, and S3. Second bent monopole 304*b* also includes segments S8, S9, S10, and S11. The six bends of second bent monopole 304*b* are also shown.

With reference to FIG. 5C, an example for third bent monopole 304*c* includes feedline segment 306 and second segment 308(2). These correspond to segments S0 and S2. Third bent monopole 304*c* also includes segment S12. The two bends of third bent monopole 304*c* are also shown.

Figure 5D:
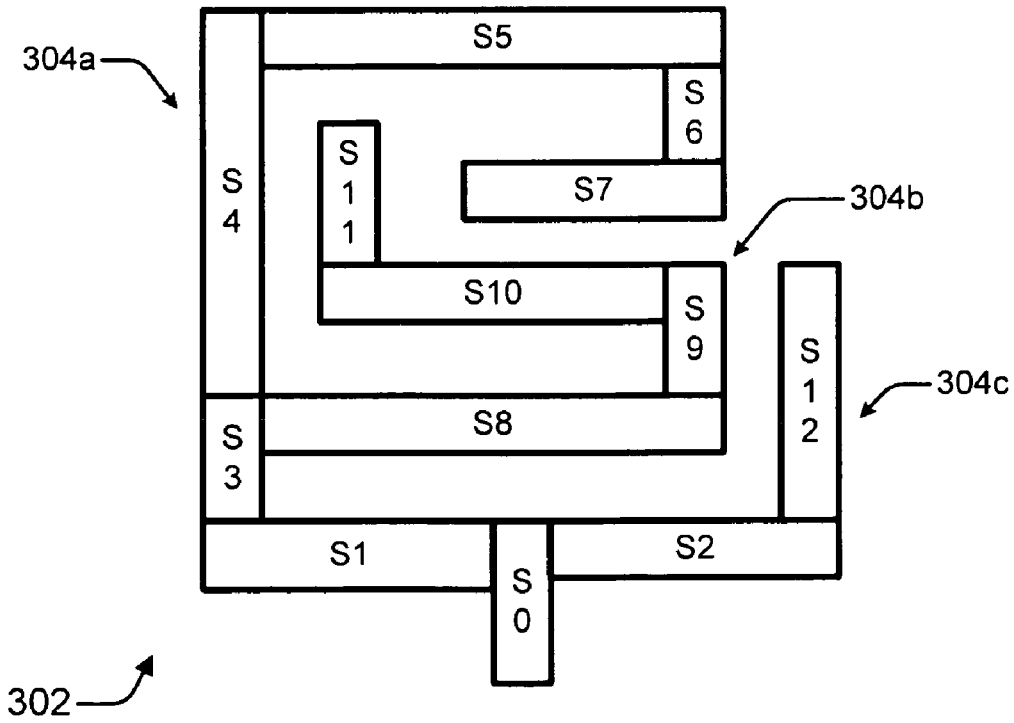
FIG. 5D jointly illustrates the first, second, and third bent monopoles in terms of their constituent segments.

FIG. 5D illustrates first bent monopole 304*a*, second bent monopole 304*b*, and third bent monopole 304*c* in terms of their constituent segments to jointly show antenna 302. As illustrated, first bent monopole 304*a* includes segments S0, S1, S3, S4, S5, S6, and S7. Second bent monopole 304*b* includes segments S0, S1, S3, S8, S9, S10, and S11. Third bent monopole 304*c* includes segments S0, S2, and S12. Hence, each of first bent monopole 304*a*, second bent monopole 304*b*, and third bent monopole 304*c* include one or more bends. Although the bends are shown as being relatively angular, the bent monopoles may alternatively be fabricated with rounded bends to decrease spurious electromagnetic radiation.

For the example embodiment of FIG. 5D, it can be visually discerned that the width of segment S1 is greater than the width of segment S2. It is also apparent that second bent monopole 304*b* branches apart from first bent monopole 304*a* after the first segment S1 such that both first bent monopole 304*a* and second bent monopole 304*b* each include at least one segment that is not shared by the other (e.g., segment S4 for first bent monopole 304*a* and segment S8 for second bent monopole 304*b*).

Moreover, it can be seen that the second segment S2 is not shared by first bent monopole 304*a* or second bent monopole 304*b*. However, they do share a third segment S3 in the example of FIG. 5D. More specifically, first bent monopole 304*a* includes the third segment S3 and a fourth segment S4, and second bent monopole 304*b* includes the third segment S3. The third segment S3 is thus shared by first bent monopole 304*a* and second bent monopole 304*b*, but the fourth segment S4 of first bent monopole 304*a* is not shared.

For an example implementation, antenna 302 is capable of tri-band communication involving a lower frequency band, a middle frequency band, and a higher frequency band. First bent monopole 304*a* is tuned for the lower frequency band. First bent monopole 304*a*, second bent monopole 304*b*, and third bent monopole 304*c* form an antenna layout pattern on the substrate, with the antenna layout pattern including an exterior edge. For the example layout pattern of FIG. 5D, the exterior edge forms a rectangle that is nearly square, but alternative shapes may be formed by the layout pattern. First bent monopole 304*a*, which is likely to be the longest bent monopole to accommodate the lower frequency band, is located at least partially along the exterior edge of the antenna layout pattern.

In another example implementation, each bent monopole is tuned to substantially match a predetermined bandwidth by adjusting its length and/or number of bends. A predetermined bandwidth may be substantially matched when it is matched sufficiently closely that a device using the resulting antenna is qualified to communicate in accordance with a given standard or regulation that promulgated the predetermined bandwidth. Thus, a first combination of a first length and one or more bends of first bent monopole 304*a* may tune first bent monopole 304*a* to substantially match a first bandwidth. A second combination of a second length and one or more bends of second bent monopole 304*b* may tune second bent monopole 304*b* to substantially match a second bandwidth. A third combination of a third length and one or more bends of third bent monopole 304*c* may tune third bent monopole 304*c* to substantially match a third bandwidth.

Figure 6:
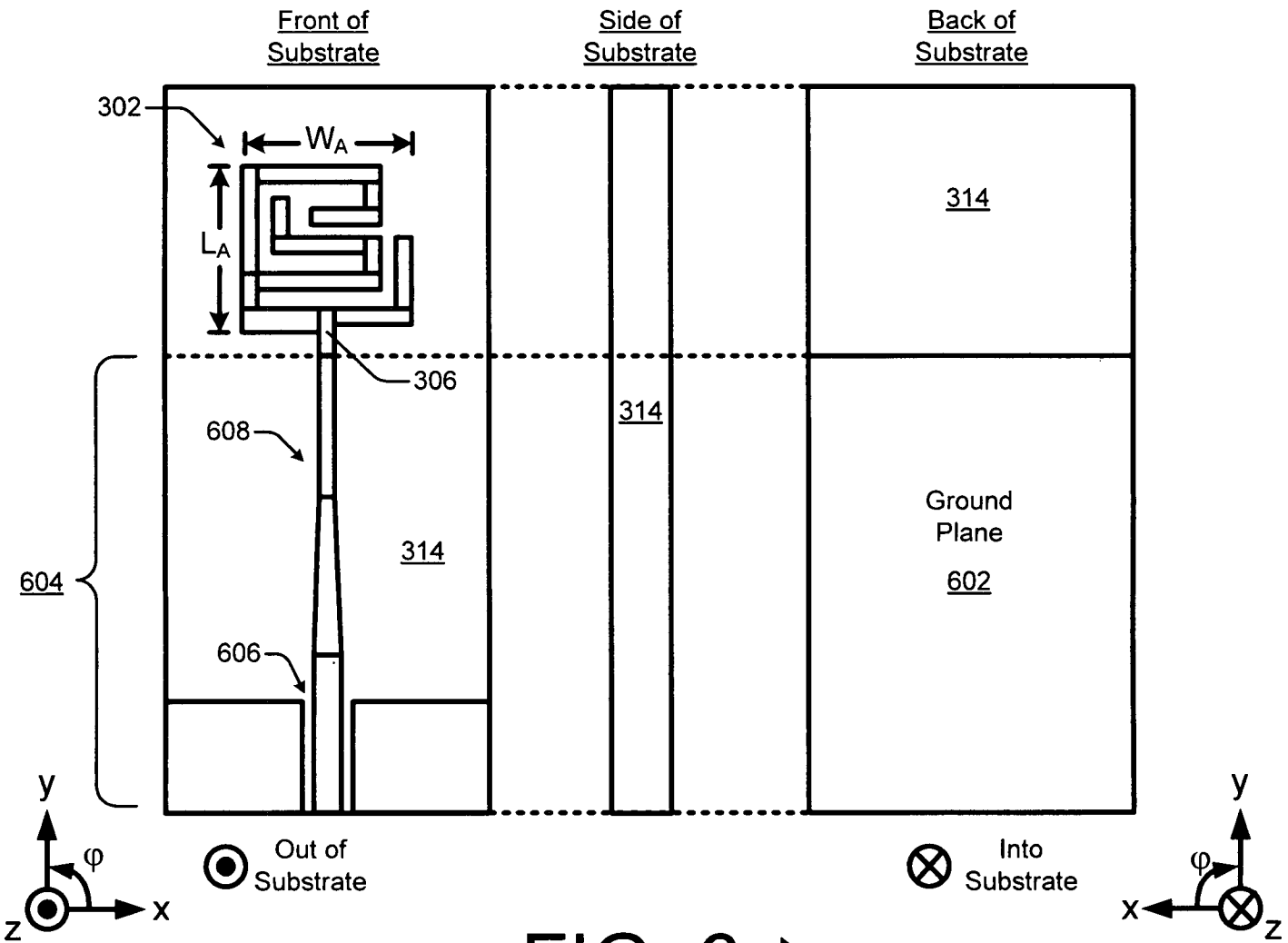
FIG. 6 is a block diagram of an example antenna assembly that has an antenna with three bent monopoles and that may be included in a device.

FIG. 6 is a block diagram of an example antenna assembly 204 that includes an antenna 302 having three bent monopoles and that may be included in a device (e.g., a device 202 of FIG. 2). As illustrated, antenna assembly 204 includes substrate 314, a ground plane 602, a feedline 604, a co-planar waveguide (CPW) portion 606, and a microstrip portion 608. The front of substrate 314, the side of substrate 314, and the back of substrate 314 are shown from left to right. An x-y-z axis indicating a direction out of substrate 314 and an x-y-z axis indicating a direction into substrate 314 are also shown.

For example embodiments, antenna 302 is disposed on the front side of substrate 314. A length ($L_A$) and width ($W_A$) of antenna 302 are indicated. In other words, first bent monopole 304*a*, second bent monopole 304*b*, and third bent monopole 304*c* jointly form an antenna layout pattern on substrate 314. This antenna layout pattern has a length and a width. The length can be less than 12 millimeters (mm), and the width can be less than 12.5 mm, while still covering three WiMAX bands. The antenna layout pattern defines an antenna plane on a front side of substrate 314.

Substrate 314 may be a flexible material (e.g., a Duroid® material from Rogers Corp.), a liquid crystal polymer (LCP), a printed circuit board (PCB), some combination thereof, and so forth. Ground plane 602 is disposed on the back side of substrate 314. Ground plane 602 is substantially parallel to, but offset from (e.g., by the thickness of substrate 314), the antenna plane. Feedline 604 is disposed on the front side of substrate 314. Feedline 604 is coupled to feedline segment 306. Feedline 604 may be comprised of, by way of example but not limitation, a microstrip, a slotline, a CPW, some combination thereof, and so forth.

As shown, feedline 604 includes a CPW portion 606 and a microstrip portion 608. The tapering of microstrip portion 608 is implemented for impedance-matching purposes with regard to feedline segment 306. It may be omitted or an alternative impedance matching technique may be implemented. CPW portion 606, and the ground pads thereof, is implemented to facilitate connection of antenna assembly 204 as a discrete article to a signal source. Especially if antenna 302 is integrated with other components, CPW portion 606 may be omitted or substituted with another type of feedline or feedline portion.

Specific example implementations are described below. Materials and measurements are set forth by way of example only. In other words, embodiments may be realized using alternative materials and measurements. A comparison between each bent monopole and an analogous straight-line monopole is provided as well to further illuminate pertinent properties of different implementations for the bent monopole antenna. For the sake of clarity, but not by way of limitation, FIGS. 5D and 6 are referenced when describing these specific example implementations.

In one tested implementation, an antenna 302 has a collection of three bent monopoles 304 that are simultaneously fed by a microstrip portion 608 of a feedline 604. Substrate 314 of antenna assembly 204 may be a double copper (Cu) clad board of Rogers RT/Duroid® 5880 material ($\in_r$=2.2, tan $\delta$=0.0009) that has a thickness of 20 mils (508 μm). The bending of the monopoles enables the total size of the antenna to be relatively compact. With the segment measurements provided below in Table I, the length ($L_A$) and width ($W_A$) of the antenna is 10.5×11 mm, respectively. For a WiMAX-targeted implementation with the measurements given below, the antenna may be tuned to radiate omni-directionally for the three frequency bands around 2.5, 3.5, and 5.8 GHz.

To explain the current paths of each bent monopole at its corresponding operating frequency, the segments (S#) of antenna 302 are referenced. First bent monopole 304*a* that resonates in the 2.5 GHz band is represented by segments S0-S1-S3-S4-S5-S6-S7. This bent monopole is the longest of the antenna, at least partly because it is tuned to resonate at the lowest of the three targeted frequencies. Second bent monopole 304*b* is tuned to radiate in the 3.5 GHz band and is represented by segments S0-S1-S3-S8-S9-S10-S11. Third bent monopole 304*c* is represented by segments S0-S2-S12. This shortest current path is tuned to resonate in the 5.8 GHz band, the highest frequency of the WiMAX band under consideration in this example implementation.

Example lengths of the segments S1-S12 are shown in Table I below. (Segment S0 has a length of 3 mm.) The feedline supplies current directly into resonant first and third bent monopoles in the 2.5 and 5.8 GHz bands. In contrast, the second bent monopole, which operates in the 3.5 GHz band, is partially fed via the connection of the segments S8-S9-S10-S11 to the first bent monopole at segment S3.

TABLE I

Length of line Segments of the Bent Monopole Antenna.

| Segment | Length (mm) |
|---|---|
| S1 | 4.9 |
| S2 | 4.9 |
| S3 | 2.2 |
| S4 | 6.8 |
| S5 | 8 |
| S6 | 1.7 |
| S7 | 4.5 |
| S8 | 8 |
| S9 | 2.3 |
| S10 | 6 |
| S11 | 2.5 |
| S12 | 5 |

To create lateral board space for the presence of second bent monopole 304*b*, the position of first bent monopole 304*a* in the antenna layout pattern is strategically located along the outside of the structure. This enables the overall antenna to maintain a relatively compact size. The widths of segments S0 and S2-S12 are each 1 mm; however, the width of segment S1 is 1.3 mm. Thus, the width of segment S1 is greater than the width of segment S2. This width differentiation helps to achieve a given level of impedance performance for each of the three bands.

The feeding mechanism for an example implementation is a conductor backed CPW to microstrip transition (e.g., CPW portion 606 and microstrip portion 608). As noted above, in an integrated system or another alternative design, the CPW may be omitted, and/or an entirely different mechanism for feedline 604 may be utilized. The termination of ground plane 602 at the end of the microstrip portion 608 can facilitate a relatively uncompromised omni-directional radiation from antenna 302. Also shown in FIG. 6 is a tapered line as part of feedline 604 that transforms the signal line of the 50Ω CPW feed to a thinner, higher impedance microstrip line.

A comparative analysis between a straight line monopole and each of the bent monopoles is described. A step in the analysis is to consider a straight line monopole to carefully examine the frequencies and sources of radiation in the return loss. A straight line monopole may be realized as an extension of a feedline strip beyond an opposing ground plane. For an equivalent comparison, the width of the monopole is given to be 1 mm. In this design, the length, $L_M$, of the monopole is analyzed for four different values.

Return loss plots were calculated. The return loss plots of the four monopole lengths revealed that resonances around 2.2 GHz and between 7.3-7.6 GHz exhibit little variation. It is therefore concluded that the source of these resonances is from the microstrip line radiation. On the other hand, as the length increases, the return loss plots revealed that the frequency decreases. It can thus be inferred that this resonance is a direct property of the monopole.

When considering such a monopole antenna, two points are relevant. The first concerns the length of the straight line monopole that terminates at the edge of the ground. The reason for this is the fringe field effect where the microstrip mode ends and the monopole antenna begins can be very small (e.g., approximately 2-3% of the length of the microstrip line). Consequently, the fringing field effect can be neglected for this case. The second point to consider is the fact that this straight line monopole is not a "true" monopole antenna because the ground is offset by the thickness of the substrate, which is 20 mils for this comparative analysis. If the ground of a CPW is extended to be the same length as the ground on the backside of the substrate, then the result is more closely related to a "true" monopole antenna. However, this procedure was not enacted for this design in an effort not to disturb the near fields of the antenna for the comparative analysis.

In the next step of this investigation, analyses were performed to determine the effect of the resonant length upon comparing the bent monopole to the straight line monopole antenna. First, second, and third bent monopoles were analyzed individually to determine their respective resonant frequencies. The length, $L_M$, of the straight line monopole was then adjusted until the resonant frequency matched that of the individual bent monopoles.

Table II below shows the resonant frequencies and total lengths of the individual first, second, and third bent monopole (nos. 1, 2, and 3); the corresponding lengths of the straight line monopoles used to achieve the same resonant frequency; the percentage deviation between these two lengths; and the number of discontinuities (e.g., bends) in the bent monopoles.

TABLE II

Comparison between Bent Monopole and Straight Line Antenna.

| Bent Monopole No. | Resonant Frequency (GHz) | Total Length of Bent Monopole (mm) | Corresponding Length of Straight Line Monopole (mm) | Percentage Deviation (%) | Number of Discontinuities (Bends) |
|---|---|---|---|---|---|
| 1 | 3.09 | 31.1 | 24.1 | 22.5 | 5 |
| 2 | 3.84 | 28.9 | 18.8 | 35.0 | 6 |
| 3 | 5.71 | 12.9 | 11.4 | 11.6 | 2 |

From Table II, it can be ascertained that the first bent monopole includes five bends, the second bent monopole includes six bends, and the third bent monopole includes two bends. The first bent monopole is approximately 31 mm long (e.g., 31 mm+/−10%), the second bent monopole is approximately 29 mm long, and the third bent monopole is approximately 13 mm long. (The total lengths of the bent monopoles are ascertained by adding the lengths of the segments. For example, for the third bent monopole, the total length is S0→3 mm+S2→4.9 mm+S12→5 mm=12.9 mm.)

It is observed from Table II that the resonant length of the corresponding straight line monopole antenna is greatly affected by bending the structure. It can be inferred that an increase in the number of discontinuities that are present in the bent monopole results in an increase in its total length in order to resonate at a given frequency. Evidence of the accuracy of this observation is that the number of discontinuities is largest in the second bent monopole where the largest percent deviation occurs. Conversely, the number of discontinuities in the third bent monopole is small and, as a result, the smallest percent deviation is observed. It should be noted that although the resonant frequencies are shifted in the individual bent monopole designs, they are tuned more closely, at least for the measurements provided above, when the bent monopoles are integrated together to produce the overall tri-band antenna.

Figure 7:
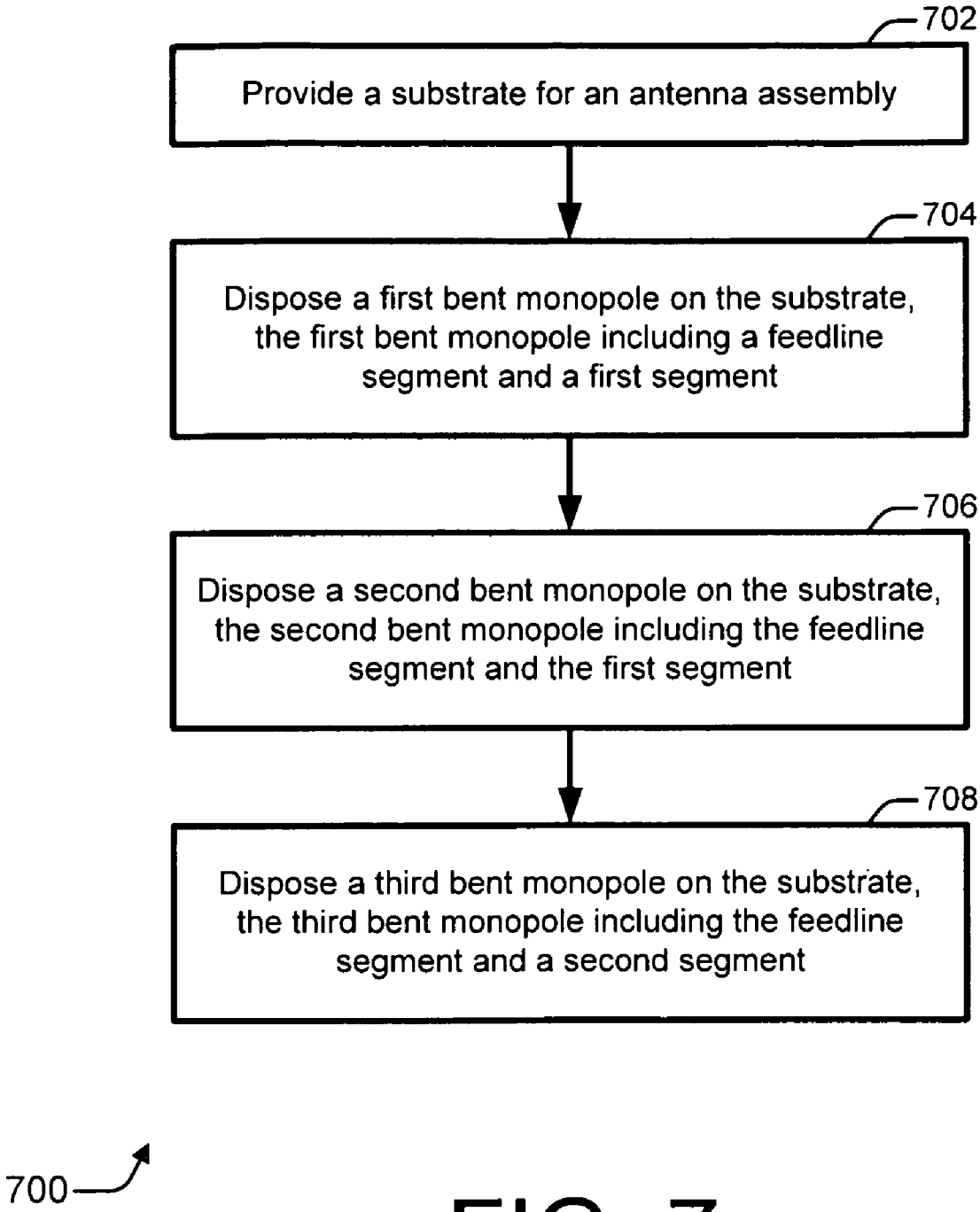
FIG. 7 is a flow diagram that illustrates an example of a method for constructing an antenna assembly having an antenna with three bent monopoles that is capable of tri-band communication.

FIG. 7 is a flow diagram 700 that illustrates an example of a method for constructing an antenna assembly having an antenna with three bent monopoles that is capable of tri-band communication. Flow diagram 700 includes four blocks 702-708. Example embodiments for implementing flow diagram 700 are described below in conjunction with the description of FIGS. 3-6. The order in which the method is described is not intended to be construed as a limitation, and any number of the described blocks can be combined, augmented, rearranged, and/or omitted to implement a respective method, or an alternative method that is equivalent thereto. Moreover, the act(s) of different blocks may be performed fully or partially in parallel.

Although specific elements of FIGS. 3-6 are referenced in the description of the acts of this flow diagram, the method may be performed with alternative elements. For example embodiments, at block 702, a substrate for an antenna assembly is provided. For example, a substrate 314 may be provided for an antenna assembly 204. At block 704, a first bent monopole is disposed on the substrate, with the first bent monopole including a feedline segment and a first segment. For example, a first bent monopole 304*a* may be disposed on substrate 314. First bent monopole 304*a* may include a feedline segment 306 and a first segment 308(1).

At block 706, a second bent monopole is disposed on the substrate, with the second bent monopole including the feedline segment and the first segment. Thus, the first bent monopole and the second bent monopole share both the feedline segment and the first segment. For example, a second bent monopole 304*b* may be disposed on substrate 314. Second bent monopole 304*b* may include feedline segment 306 and first segment 308(1). Feedline segment 306 and first segment 308(1) may both be shared by first bent monopole 304*a* and second bent monopole 304*b*.

At block 708, a third bent monopole is disposed on the substrate, with the third bent monopole including the feedline segment and a second segment. Thus, the first bent monopole, the second bent monopole, and the third bent monopole share the feedline segment. Also, the feedline segment, the first segment, and the second segment form a T-junction. For example, a third bent monopole 304*c* may be disposed on substrate 314. Third bent monopole 304*c* may include feedline segment 306 and a second segment 308(2). Feedline segment 306 may be shared by first bent monopole 304*a*, second bent monopole 304*b*, and third bent monopole 304*c*. Feedline segment 306, first segment 308(1), and second segment 308(2) may form a T-junction 310 on substrate 314.

In an example implementation, the first segment is created at a first width, and the second segment is created at a second width. The first width of the first segment is created to be greater than the second width of the second segment. For example, first segment 308(1) may be created at a first width 402(1), and second segment 308(2) may be created at a second width 402(2). More specifically, first width 402(1) of first segment 308(1) may be created to be wider than second width 402(2) of second segment 308(2).

The devices, acts, features, functions, methods, assembly structures, techniques, components, etc. of FIGS. 2-7 are illustrated in diagrams that are divided into multiple blocks and other elements. However, the order, interconnections, interrelationships, layout, etc. in which FIGS. 2-7 are described and/or shown are not intended to be construed as a limitation, and any number of the blocks and/or other elements can be modified, combined, rearranged, augmented, omitted, etc. in many manners to implement one or more systems, methods, devices, assemblies, apparatuses, arrangements, etc. for a bent monopole antenna having shared segments.

Although systems, methods, devices, assemblies, apparatuses, arrangements, and other example embodiments have been described in language specific to structural, operational, and/or functional features, it is to be understood that the invention defined in the appended claims is not necessarily limited to the specific features or acts described above. Rather, the specific features and acts described above are disclosed as example forms of implementing the claimed invention.

What is claimed is:

1. A device that is capable of tri-band communication, the device comprising:

an antenna assembly, the antenna assembly including:

a substrate;

a first bent monopole that is disposed on the substrate, the first bent monopole comprising a feedline segment and a first segment;

a second bent monopole that is disposed on the substrate, the second bent monopole comprising the feedline segment and the first segment; and a third bent monopole that is disposed on the substrate, the third bent monopole comprising the feedline segment and a second segment;

wherein a T-junction is formed by the feedline segment, the first segment, and the second segment and wherein the first segment has a first width and a first end located at the T-junction and a second end located at a branch junction where the first and second bent monopoles branch apart from one another, and wherein the second segment has a second width that is 20% to 40% less than the first width of the first segment;

wherein the first bent monopole, the second bent monopole, and the third bent monopole are coplanar and share the feedline segment; and the first bent monopole and the second bent monopole, but not the third bent monopole, share the first segment; and wherein a first combination of a first length and one or more bends of the first bent monopole tune the first bent monopole to substantially match a first bandwidth, a second combination of a second length and one or more bends of the second bent monopole tune the second bent monopole to substantially match a second bandwidth, and a third combination of a third length and one or more bends of the third bent monopole tune the third bent monopole to substantially match a third bandwidth; and wherein the first bent monopole, the second bent monopole, and the third bent monopole form an antenna layout pattern on the substrate, with the antenna layout pattern having a length and a width; and wherein the length is less than 12 millimeters (mm), and the width is less than 12.5 mm, the first bent monopole being located along an exterior edge of the antenna layout pattern.

2. The device as recited in claim 1, wherein the first bandwidth corresponds to a Worldwide Interoperability for Microwave Access (WiMAX) frequency band of 2.3-2.7 GHz, the second bandwidth corresponds to a WiMAX frequency band of 3.3-3.7 GHz, and the third bandwidth corresponds to a WiMAX frequency band of 5.8 GHz.

3. The device as recited in claim 1, wherein the device comprises a wireless network interface card, a wireless modem, a radio, a wireless access point, a network component, a server computer, a personal computer, a hand-held or other portable electronic gadget, a mobile phone, or an entertainment appliance.

4. The device as recited in claim 1, wherein the second bent monopole branches apart from the first bent monopole after the first segment such that both the first bent monopole and the second bent monopole each comprise at least one segment that is not shared by the other.

5. An antenna assembly that is capable of tri-band communication, the antenna assembly comprising:

a substrate;

a first bent monopole that is disposed on the substrate, the first bent monopole comprising a feedline segment and a first segment;

a second bent monopole that is disposed on the substrate, the second bent monopole comprising the feedline segment and the first segment; and a third bent monopole that is disposed on the substrate, the third bent monopole comprising the feedline segment and a second segment;

wherein a T-junction is formed by the feedline segment, the first segment, and the second segment, wherein the first bent monopole, the second bent monopole, and the third bent monopole share the feedline segment; and the first bent monopole and the second bent monopole share the first segment and wherein the first bent monopole further comprises a third segment and a fourth segment, and the second bent monopole further comprises the third segment; and wherein the first bent monopole and the second bent monopole share the third segment but not the fourth segment.

6. The antenna assembly as recited in claim 5, wherein the first segment has a first width, and the second segment has a second width; and wherein the first width of the first segment is greater than the second width of the second segment.

7. The antenna assembly as recited in claim 6, wherein the first width of the first segment being greater than the second width of the second segment is to enable relatively more signal energy from the feedline segment to be channeled to the first bent monopole and the second bent monopole jointly as compared to the third bent monopole.

8. The antenna assembly as recited in claim 5, wherein the substrate comprises a flexible material, a liquid crystal polymer (LCP), or a printed circuit board (PCB).

9. The antenna assembly as recited in claim 5, further comprising:

a feedline that is coupled to the feedline segment;

wherein the feedline comprises a microstrip, a slotline, or a co-planar waveguide (CPW).

10. The antenna assembly as recited in claim 5, wherein the tri-band communication involves a lower frequency band, a middle frequency band, and a higher frequency band; wherein the first bent monopole is tuned for the lower frequency band; wherein the first bent monopole, the second bent monopole, and the third bent monopole form an antenna layout pattern on the substrate, the antenna layout pattern including an exterior edge; and wherein the first bent monopole is located at least partially along the exterior edge of the antenna layout pattern.

11. The antenna assembly as recited in claim 5, wherein the first bent monopole, the second bent monopole, and the third bent monopole form an antenna layout pattern on the substrate, the antenna layout pattern defining an antenna plane; and wherein the antenna assembly further comprises:

a ground plane that is substantially parallel to, but offset from, the antenna plane.

12. The antenna assembly as recited in claim 5, wherein the second segment is not shared by the first bent monopole or the second bent monopole.

13. The antenna assembly as recited in claim 5, wherein each of the first bent monopole, the second bent monopole, and the third bent monopole includes one or more bends; and wherein the one or more bends are angular or rounded.

14. The antenna assembly as recited in claim 5, wherein the first bent monopole includes at least five bends, the second bent monopole includes at least six bends, and the third bent monopole includes at least two bends; and wherein the first bent monopole is approximately 31 millimeters (mm) long, the second bent monopole is approximately 29 mm long, and the third bent monopole is approximately 13 mm long.

15. A method for constructing an antenna assembly that is capable of tri-band communication, the method comprising acts of:

providing a substrate;

disposing a first bent monopole on the substrate, the first bent monopole comprising a feedline segment and a first segment, and having at least five bends and being approximately 31 millimeters (mm) long;

disposing a second bent monopole on the substrate, the second bent monopole comprising the feedline segment and the first segment such that the first bent monopole and the second bent monopole share the feedline segment and the first segment, the second bent monopole including at least six bends and being approximately 29 mm long;

disposing a third bent monopole on the substrate, the third bent monopole comprising the feedline segment and a second segment such that the first bent monopole, the second bent monopole, and the third bent monopole share the feedline segment, the third bent monopole including at least two bends and being approximately 13 mm long;

wherein a T-junction is formed by the feedline segment, the first segment, and the second segment, and wherein the first segment has a first end thereof disposed at the T-junction and a second thereof disposed at a branch junction where the first and second bent monopoles branch apart from one another.

16. The method as recited in claim 15, wherein the method further comprises acts of:

creating the first segment at a first width; and creating the second segment at a second width, the first width of the first segment being greater than the second width of the second segment.

* * * * *